United States Patent [19]

Harle

[11] 4,166,726

[45] Sep. 4, 1979

[54] DIESEL FUEL CONTAINING POLYALKYLENE AMINE AND MANNICH BASE

[75] Inventor: Oliver L. Harle, San Anselmo, Calif.

[73] Assignee: Chevron Research Company, San Francisco, Calif.

[21] Appl. No.: 861,482

[22] Filed: Dec. 16, 1977

[51] Int. Cl.[2] ..... C10L 1/22
[52] U.S. Cl. ..... 44/73
[58] Field of Search ..... 44/73, 75

[56] References Cited

U.S. PATENT DOCUMENTS

| | | | |
|---|---|---|---|
| 4,038,043 | 7/1977 | Garth | 44/73 |
| 4,038,044 | 7/1977 | Garth | 44/73 |

*Primary Examiner*—Winston A. Douglas
*Assistant Examiner*—Y. Harris-Smith
*Attorney, Agent, or Firm*—D. A. Newell; J. J. DeYoung

[57] ABSTRACT

Disclosed is a fuel additive and fuel composition. The additive comprises a mixture of a polyalkylene amine and the reaction product of an alkylphenol, an aldehyde and an amine. The additive provides surprising stability in preventing thermal degradation of fuels, particularly fuels for compression ignition engines.

15 Claims, No Drawings

DIESEL FUEL CONTAINING POLYALKYLENE AMINE AND MANNICH BASE

BACKGROUND OF THE INVENTION

The invention relates to a novel, multi-functional fuel additive and fuel composition containing said additive.

Fuels are susceptible to chemical reaction on aging. One effect of oxidation is to produce soluble and insoluble materials of higher molecular weight and boiling point than the original fuel. The deterioration due to oxidation and the like of distillate fuels, particularly in diesel fuel, manifests itself, for example, through the appearance of color and gums. The tacky oxidized fuel deposits adhere readily to injector parts and can cause injector sticking, nozzle-hole plugging and leakage past critical surfaces.

Also, diesel engines are equipped with fuel filters to remove particulate matter from the fuel. Any gums which are present in the fuel tend to coat onto the filter, requiring frequent changes of the filter in order to permit adequate fuel flow as well as effective filtering action.

While many materials might effectively act as commercially successful dispersants for the gum, the field is severely limited to relatively few materials. Also, since the dispersant is an additive to the fuel, it must not significantly increase the deposits created in the combustion chamber, which interfere with the proper functioning of the piston. In order to have an acceptable fuel dispersant, it is not only necessary that the dispersant maintain the gums dispersed in the fuel mixture, but the dispersant itself, when introduced into the combustion chamber, should not form deposits which significantly interfere with the operation of the piston.

Polyalkylene amines, particularly polybutene amines, are well known as providing excellent detergency in spark ignition engines. See, for example, U.S. Pat. No. 3,438,757 or 3,898,065, which disclose various amines as having excellent detergency and dispersancy properties in fuels.

The Mannich condensation reaction is well known in the art and involves the reaction of an alkylphenol, an aldehyde and an amine. Mannich bases and the metal phenates derived therefrom have been used in lubricants and fuels as anti-oxidants and dispersants. See, for example, U.S. Pat. Nos. 2,353,491, 2,363,134, 3,454,497 and 4,025,451.

SUMMARY OF THE INVENTION

It has been discovered that a fuel composition for compression ignition engines which comprises a major amount of a hydrocarbon boiling within the range 120°–455° C. and containing from 5 to 300 parts per million (ppm) of a polyalkylene amine and from 5 to 300 ppm of the reaction product of: (a) alkylphenol; (b) aldehyde; (c) an amine, exhibits surprising anti-oxidation and thermal stability.

DETAILED DESCRIPTION OF PREFERRED EMBODIMENTS

The additive composition of the present invention contains two components, a polyalkylene amine and a Mannich base.

Mannich Condensation Reaction

The Mannich condensation reaction is well known in the art, and involves the condensation of an alkylphenol, an aldehyde and an amine.

The alkylated phenols useful in this invention are of the formula:

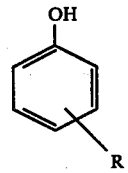

wherein R may be a straight or branched chain alkyl group having from 1 to 100 carbon atoms and preferably from 10 to 30 carbon atoms. The R groups or alkyl groups may be present on any or all of the sites around the phenolic ring, i.e., ortho, meta or para. Preferably, the R groups will predominantly be meta or para. That is, less than 40 percent of the R groups will be in the ortho position and preferably less than 15 percent of the R groups will be in the ortho position. A particularly preferred alkylated phenol is dodecylphenol.

Examples of suitable alkyls include octyl, decyl, dodecyl, ethylhexyl, triacontyl, etc.; radicals derived from petroleum hydrocarbons such as white oil, wax, olefin polymers (e.g., polypropylene, polybutylene, etc.), etc. While one specific structure is indicated by the above formula, it should be recognized that mixtures of alkylated phenols can be successfully employed in this invention.

Aldehydes having the following formula are suitable for use in the condensation reaction of the present invention:

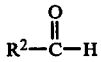

wherein $R^2$ is selected from hydrogen and alkyl radicals containing from 1–6 carbon atoms. Examples of suitable aldehydes including formaldehyde, acetaldehyde, propanaldehyde, butrylaldehyde, hexaldehyde and heptaldehyde. The most preferred aldehyde reactant is formaldehyde, which may be used in its monomeric or its polymeric form, such as paraformaldehyde.

The amines suitable for use in the condensation reaction contain one or more amino groups and at least one active hydrogen atom. Suitable amines include primary amines and secondary amines. Examples include the primary alkyl amines such as methyl amine, ethyl amine, n-propyl amine, isopropyl amine, n-butyl amine, isobutyl amine, 2-ethylhexyl amine, dodecyl amine, stearyl amine, and the like. Also, dialkyl amines may be used, such as dimethyl amine, diethyl amine, methylethyl amine, methylbutyl amine, and the like; also polyfunctional amines, such as, N,N-dimethylaminopropyleneamine, 3-methylaminopyridine, ethyl-4-aminopentylamine, N-(2'-aminoethyl)-piperidine, 2-amino-2-hydroxymethylbutanol, including mixtures thereof. A preferred amine is methyl amine.

The condensation reaction will occur by simply warming the reactant mixture to a temperature sufficient to effect the reaction. The reaction will proceed at temperatures ranging from about 50° to 200° C. A more preferred temperature range is from 75° to 175° C. The time required to complete the reaction depends upon the reactants employed and the reaction temperature used. Under most conditions, reaction is complete in about 1 to 8 hours.

The amount of alkylated phenol, formaldehyde and amine present within the reaction medium generally ranges from 0.5 to 5 molar parts of primary amine and from 0.75 to 4 molar parts of formaldehyde per molar part of alkylated phenol. Preferably, the molar ratio of the phenol to the amine to formaldehyde varies from 1:1–4:2–3.5 and more preferably is from 1:1–1.5:2–3. Also, preferably, the reactants are chosen such that the total number of carbon atoms in the reaction product is less than 36 and more preferably less than 25.

Polyalkylene Amine

The polyalkylene amines which are suitable for use in the present invention are commercially available materials which are generally known for their detergent or dispersant properties. See, for example, U.S. Pat. Nos. 3,898,056, 3,438,757 and 4,022,589 for representative polyalkylene amines and methods of manufacture. The disclosures of these three patents are incorporated herein by reference.

As used in the present application, the term "polyalkylene amine" include monoamines and polyamines.

The polyalkylene amines are readily prepared by halogenating a relatively low molecular weight polyalkylene, such as polyisobutylene, followed by reaction with a suitable amine such as ethylenediamine.

The polyalkylene may be prepared by ionic or free-radical polymerization of olefins having from 2 to 6 carbon atoms (ethylene must be copolymerized with another olefin) to an olefin of the desired molecular weight. Suitable olefins include ethylene, propylene, isobutylene, 1-butene, 1-pentene, 3-methyl-1-pentene, 4-methyl-1-pentene, etc. Propylene and isobutylene are most preferred.

The alkylene radical may have from 2 to 6 carbon atoms, and more usually from 2 to 4 carbon atoms. The alkylene group may be straight or branched chain.

The amines are selected from hydrocarbylamines, alkyoxy-substituted hydrocarbylamines, and alkylene polyamines. Specific examples of hydrocarbylamines include methylamine, propylamine, butylamine, pentylamine, hexylamine, heptylamine, octylamine, di-n-butylamine, di-n-hexylamine, decylamine, dodecylamine, hexadecylamine, octadecylamine, etc. Specific examples of alkoxy-substituted hydrocarbyl amines include methoxyethylamine, butoxyhexylamine, propoxypropylamine, heptoxy-ethylamine, etc., as well as the poly(alkoxy)amines such as poly(ethoxy)ethylamine, poly(propoxy)ethylamine, poly(propoxy)-propylamine and the like.

Suitable examples of alkylene polyamines include, for the most part, alkylene polyamines conforming to the formula $$H-\underset{\underset{R^1}{|}}{N}-(Alkylene-\underset{\underset{R^1}{|}}{N})_n R^1$$

wherein (A) n is an integer preferably less than about 10; (B) each R′ independently represents hydrogen or a substantially saturated hydrocarbon radical; and (C) each Alkylene radical can be the same or different and is preferably a lower alkylene radical having 8 or less carbon atoms, and when Alkylene represents ethylene, the two R′ groups on adjacent nitrogen atoms may be taken together to form an ethylene group, thus forming a piperazine ring.

In a preferred embodiment, R′ represents hydrogen, methyl or ethyl. The alkylene amines include principally methylene amines, ethylene amines, propylene amines, butylene amines, pentylene amines, hexylene amines, heptylene amines, ocytlene amines, other polymethylene amines, and also the cyclic and the higher homologs of such amines such as piperazines and amino-alkyl-substituted piperazines. These amines are exemplified specifically by: ethylene diamine, diethylene triamine, triethylene tetramine, propylene diamine, octamethylene diamine, di(heptamethylene) triamine, tripropylene tetramine, tetraethylene pentamine, trimethylene diamine, pentaethylene hexamine, di(-trimethylene) triamine, 2-heptyl-3-(2-aminopropyl)-imidazoline, 4-methylimidazoline, 1,3-bis(2-aminoethyl)-imidazoline, 1-(2-aminopropyl)piperazine, 1,4-bis(2-aminoethyl)-piperazine, and 2-methyl-1-(2-aminobutyl)piperazine. Higher homologs such as are obtained by condensing two or more of the above-illustrated alkylene amines likewise are useful.

The polyalkylene amine will generally have an average molecular weight in the range of 220 to 2700, preferably 1000 to 1500 and will have been reacted with sufficient amine to contain from 0.8 to 7.0, preferably 0.8 to 1.2 weight percent basic nitrogen.

Fuel Additive and Fuel Composition

The mixture of polyalkylene amines and the Mannich condensation reaction product is employed in an effective amount in a hydrocarbon fuel. Preferably, the fuel is suitable for compression ignition engines but the additive can also be used in other fuels, e.g., heating fuel and fuels for spark ignition engines. The preferred fuels for compression ignition engines will generally have a boiling point between 120°–455° C., and more commonly in the range 175° to 370° C. The specifications for conventional diesel fuels are set forth in ASTM D-975-68.

The proper concentration of additives necessary in order to achieve the desired stabilization of the fuel will vary, depending on the type of fuel employed, the presence of other additives, etc. Generally, however, from 5 to 300 ppm, preferably from 10 to 200, and most preferably from 25 to 100 ppm of the polyalkylene amine and the Mannich condensation reaction product, respectively, are employed in the fuel.

In general, the polyalkylene amine and the Mannich base reaction product will most conveniently be added to the fuel as a concentrate. The concentrate may consist entirely of the polyalkylene amine and Mannich condensation reaction product. Preferably, however, a solvent is employed to prepare a concentrate containing 25 to 100 weight percent active ingredients. Aliphatic alcohols and aromatic or saturated aliphatic hydrocarbons are suitable. Some examples include isopropanol, toluene, xylene and the like. The ratio of the polyalkylene amine to the Mannich condensation reaction product in the concentrate can vary widely, from about 1:19 to 19:1, preferably 1:1 to 4:1.

It is generally considered beneficial to include a minor amount of a material which has demulsifier properties in the additive package of the present invention. Such a component, although preferred, is not essential to the stabilizing effect of the additive of the present invention. Any material which is compatible with fuels and which exhibits demulsification properties can be used. Illustrative demulsifying agents suitable for use in the present invention, but not limited thereto, include polymeric polyesters, polyolpolyethers, oxyalkylated alkylphenol/formaldehyde resin adducts, and mixtures of these materials.

In addition to the components described above, the fuel or additive concentrate can contain other conventional additives such as antioxidants, rust inhibitors, colorants, antifreeze agents and the like.

The effectiveness of the additive combination of this invention toward stabilizing diesel fuel from thermal degradation is shown by the following test. In this test, the additive package and the diesel fuel are mixed until solution is complete. The resulting solution is filtered through a Whatman No. 1 filter paper. Then a 300-ml portion of the filtrate is transferred into a 500-ml Pyrex bottles. Each bottle is covered with a piece of aluminum foil having a pin hole. The test samples are placed in an oven maintained at 105° C. for 60 hours. At the end of this time, the bottles are allowed to cool to ambient temperature in the dark. The sample bottle is shaken until all sediment is in suspension, and then it is filtered through a 5-micron-pore-size Millipore filter paper. The filter paper and precipitate collected thereon are dried in an oven at 90° C. for 2 hours. The sample bottle is washed with a total of 50 ml of gum solvent (50% methanol/acetone). This solution is transferred to tared beaker and allowed to evaporate. The weight of the filter and gum residue is then determined. The results of the test are given in Table I.

TABLE I

Effect of Polyalkyleneamine/Mannich Base Combination on the Thermal Stability of Diesel Fuel

| Test No. | Diesel Fuel | Additive | Total Additive Conc. (ppm) | Residue (ppm) |
|---|---|---|---|---|
| 1 | A | None | None | 41 |
| 2 | A | PBA-1[1] | 25 | 58 |
| 3 | A | MB-1[2] | 25 | 24 |
| 4 | A | PBA-1/MB-1, 1:1 | 25 | 20 |
| 5 | A | PBA-1/MB-1, 2:1 | 25 | 29 |
| 6 | A | PBA-1/MB-1, 3:1 | 25 | 34 |
| 7 | A | PBA-1/MB-1, 4:1 | 25 | 31 |
| 8 | B | None | None | 74 |
| 9 | B | PBA-1 | 25 | 50 |
| 10 | B | MB-1 | 25 | 45 |
| 11 | B | PBA-1/MB-1, 1:1 | 25 | 46 |
| 12 | B | PBA-1/MB-1, 2:1 | 25 | 44 |
| 13 | B | PBA-1/MB-1, 3:1 | 25 | 45 |
| 14 | B | PBA-1/MB-1, 4:1 | 25 | 33 |
| 15 | D | None | None | 157 |
| 16 | D | PBA-1 | 25 | 101 |
| 17 | D | MB-1 | 25 | 98 |
| 18 | D | PBA-1/MB-1, 1:1 | 25 | 192 |
| 19 | A | None | None | 30 |
| 10 | A | PBA-1 | 50 | 46 |
| 21 | A | MB-1 | 50 | 28 |
| 22 | A | PBA-1/MB-1, 1:1 | 50 | 14 |
| 23 | A | PBA-1/MB-1, 2:1 | 50 | 19 |
| 29 | A | PBA-1/MB-1, 3:1 | 50 | 21 |
| 25 | A | PBA-1/MB-1, 4:1 | 50 | 19 |
| 26 | C | None | None | 28,28 |
| 27 | C | PBA-1 | 50 | 40,38 |
| 28 | C | MB-1 | 50 | 13,17 |
| 29 | C | PBA-1/MB-1, 2:1 | 50 | 10,10 |
| 30 | D | None | None | 146 |
| 31 | D | PBA-1 | 50 | 124 |
| 32 | D | MB-1 | 50 | 70 |
| 33 | D | PBA-1/MB-1, 1:1 | 50 | 94 |
| 34 | E | None | None | 50 |
| 35 | E | PBA-1 | 50 | 44 |
| 36 | E | MB-1 | 50 | 15 |
| 37 | E | PBA-1/MB-1, 1:2 | 50 | 15 |
| 38 | E | PBA-1/MB-1, 1:4 | 50 | 12 |

TABLE I-continued

Effect of Polyalkyleneamine/Mannich Base Combination on the Thermal Stability of Diesel Fuel

| Test No. | Diesel Fuel | Additive | Total Additive Conc. (ppm) | Residue (ppm) |
|---|---|---|---|---|
| 39 | E | PBA-1/MB-1, 1:10 | 50 | 14 |
| 40 | E | PBA-1/MB-1, 1:15 | 50 | 16 |
| 41 | E | PBA-1/MB-1, 1:20 | 50 | 16 |
| 42 | F | None | None | 71 |
| 43 | F | PBA-2[3] | 50 | 44 |
| 44 | F | MB-1 | 50 | 27 |
| 45 | F | PBA-2/MB-1, 1:1 | 50 | 18 |
| 46 | F | PBA-2/MB-1, 2:1 | 50 | 19 |
| 47 | F | PBA-2/MB-1, 4:1 | 50 | 18 |
| 48 | G | None | None | 53 |
| 49 | G | PBA-3[4] | 50 | 42 |
| 50 | G | MB-1 | 50 | 18 |
| 51 | G | PBA-3/MB-1, 1:1 | 50 | 13 |
| 52 | G | PBA-3/MB-1, 2:1 | 50 | 14 |
| 53 | G | PBA-3/MB-1, 3:1 | 50 | 13 |
| 54 | G | PBA-3/MB-1, 4:1 | 50 | 12 |
| 55 | H | None | None | 58 |
| 56 | H | PBA-4[5] | 50 | 55 |
| 57 | H | MB-1 | 50 | 18 |
| 58 | H | PBA-4/MB-1, 1:1 | 50 | 18 |
| 59 | H | PBA-4/MB-1, 2:1 | 50 | 17 |
| 60 | H | PBA-4/MB-1, 3:1 | 50 | 18 |
| 61 | H | PBA-4/MB-1, 4:1 | 50 | 13 |
| 62 | A | None | None | 45 |
| 63 | A | PBA-1 | 100 | 43 |
| 64 | A | MB-1 | 100 | 48 |
| 65 | A | PBA-1/MB-1, 1:1 | 100 | 13 |
| 66 | A | PBA-1/MB-1, 2:1 | 100 | 19 |
| 67 | A | PBA-1/MB-1, 3:1 | 100 | 20 |
| 68 | A | PBA-1/MB-1, 4:1 | 100 | 16 |
| 69 | B | None | None | 60 |
| 70 | B | PBA-1 | 100 | 38 |
| 71 | B | MB-1 | 100 | 36 |
| 72 | B | PBA-1/MB-1, 1:1 | 100 | 29 |
| 73 | B | PBA-1/MB-1, 2:1 | 100 | 26 |
| 74 | B | PBA-1/MB-1, 3:1 | 100 | 18 |
| 75 | B | PBA-1/MB-1, 4:1 | 100 | 27 |
| 76 | C | None | None | 28,28 |
| 77 | C | PBA-1 | 100 | 35,38 |
| 78 | C | MB-1 | 100 | 13,20 |
| 79 | C | PBA-1/MB-1, 2:1 | 100 | 9,10 |
| 80 | D | None | None | 211 |
| 81 | D | PBA-1 | 100 | 98 |
| 82 | D | MB-1 | 100 | 43 |
| 83 | D | PBA-1/MB-1, 1:1 | 100 | 45 |
| 84 | E | PBA-1 | 100 | 37 |
| 85 | E | MB-1 | 100 | 20 |
| 86 | E | PBA-1/MB-1, 1:2 | 100 | 14 |
| 87 | E | PBA-1/MB-1, 1:4 | 100 | 18 |
| 88 | E | PBA-1/MB-1, 1:10 | 100 | 21 |
| 89 | E | PBA-1/MB-1, 1:15 | 100 | 16 |
| 90 | E | PBA-1/MB-1, 1:20 | 100 | 29 |
| 91 | F | PBA-2 | 100 | 49 |
| 92 | F | MB-1 | 100 | 36 |
| 93 | F | PBA-2/MB-1, 1:1 | 100 | 17 |
| 94 | F | PBA-2/MB-1, 2:1 | 100 | 20 |
| 95 | F | PBA-2/MB-1, 4:1 | 100 | 24 |
| 96 | G | PBA-3 | 100 | 38 |
| 97 | G | MB-1 | 100 | 26 |
| 98 | G | PBA-3/MB-1, 1:1 | 100 | 15 |
| 99 | G | PBA-3/MB-1, 2:1 | 100 | 13 |
| 100 | G | PBA-3/MB-1, 3:1 | 100 | 7 |
| 101 | G | PBA-3/MB-1, 4:1 | 100 | 8 |
| 102 | H | PBA-4 | 100 | 60 |
| 103 | H | MB-1 | 100 | 21 |
| 104 | H | PBA-4/MB-1, 1:1 | 100 | 15 |
| 105 | H | PBA-4/MB-1, 2:1 | 100 | 14 |
| 106 | H | PBA-4/MB-1, 3:1 | 100 | 15 |

TABLE I-continued

Effect of Polyalkyleneamine/Mannich Base Combination on the Thermal Stability of Diesel Fuel

| Test No. | Diesel Fuel | Additive | Total Additive Conc. (ppm) | Residue (ppm) |
|---|---|---|---|---|
| 107 | H | PBA-4/MB-1, 4:1 | 100 | 19 |

(1)A polybutene amine prepared from polybutene having a molecular weight of about 1300, and ethylene diamine.
(2)A Mannich base reaction product prepared from p-dodecylphenyl, formaldehyde and methylamine in a 1:1:1 mol ratio.
(3)A polybutene amine prepared from polybutene having a molecular weight of about 2700 and ethylene diamine.
(4)A polybutene amine prepared from polybutene having a molecular weight of about 950 and tetraethylene pentamine.
(5)A polybutene amine prepared from polybutene having a molecular weight of about 220 and ethylene diamine.

In the above test, it is desired to limit or eliminate the residue due to thermal decomposition. Therefore, the smaller the residue value, the better the thermal stability of the test fuel. The above results show the unexpected benefits of a polybutene amine/MB-1 mixture in stabilizing diesel fuels. In many of the examples, the quantity of residue obtained from the two-component stabilized fuels is less than that from fuel containing either of these two components and is thus clearly surprising, since the predicted residue value would lie between the values obtained with each additive alone at the same total concentration.

The surprisingly good results may be shown by the following method. The values are taken from Tests No. 2, 3, 20, 21, 22 and 65.

Polybutene amine alone
(Test 2) at 25 ppm = 58 ppm
(Test 20) at 50 ppm = 46 ppm
Mannich base alone
(Test 3) at 25 ppm = 24 ppm
(Test 21) at 50 ppm = 28 ppm A 1:1 mixture of the same polybutene amine and Mannich base at a total concentration of 50 ppm means 25 ppm of each component in the test mixture.

(Test 22) at 50 ppm = 14 ppm
(The predicted value = $\frac{58+24}{2}$ = 41 ppm)

Similarly, at 100 ppm:

(Test 65) at 100 ppm = 13 ppm
(The predicted value = $\frac{46+28}{2}$ = 37 ppm)

However, with extremely unstable fuels, such as Fuel D, the amount of stabilizer necessary to impart stability is higher. Thus, at 25 ppm, the fuel stability is poorer with the additive mixture; at 50 ppm, stability is improved; finally at 100 ppm, the additive mixture does give unexpected results. As a consequence, the quantity of the stabilizing composition to be used varies directly with the quality of the fuel being treated. With thermally unstable fuels, the amount to be used is in the upper portion of the range, i.e., from 100 ppm to 500 ppm. For more stable fuels, the quantity necessary for stability is less than 100 ppm.

Reasonable variations and modifications, which will be apparent to those skilled in the art, can be made in the invention without departing from the spirit and scope thereof.

What is claimed is:

1. A fuel composition for compression ignition engines which comprises a major amount of a hydrocarbon boiling within the range 120°–445° C. and containing from 5 to 300 parts per million of a polyalkylene amine and from 5 to 300 parts per million of the reaction product of: (a) an alkylphenol; (b) an aldehyde; and (c) an amine.

2. The composition of claim 1 wherein said alkylphenol comprises a phenol of the formula:

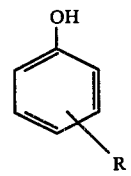

wherein R is an alkyl group having from 1 to 35 carbon atoms; said aldehyde comprises an aldehyde having the formula

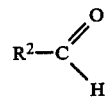

wherein $R^2$ is selected from hydrogen and alkyl radicals containing 1 to 6 carbon atoms; and said amine contains one amino group and at least one active hydrogen atom, and wherein the total number of carbon atoms in said reaction product is less than 36.

3. The composition of claim 2 wherein said polyalkylene amine has a molecular weight in the range 220 to 2700.

4. The composition of claim 3 wherein said fuel contains 10 to 200 parts per million of said polyalkylene amine and from 10 to 200 parts per million of said reaction product.

5. The composition of claim 4 wherein said polyalkylene amine is a polybutene amine.

6. The composition of claim 5 wherein said alkylphenol comprises dodecylphenol, said aldehyde is formaldehyde and said amine is methylamine and said polyalkylene amine is a polyisobutylene amine.

7. The composition of claim 6 wherein said polyalkylene amine comprises polyisobutylene amine having a molecular weight in the range 1000 to 1500.

8. The composition of claim 7 wherein said fuel contains 25 to 100 ppm of said polyalkylene amine and from 25 to 100 ppm of said reaction product.

9. A fuel additive concentrate comprising a mixture of:

(A) a polyalkylene amine; and (B) the reaction product of: (a) an alkylphenol; (b) an aldehyde and (c) an amine; and wherein the ratio of said polyalkylene amine to said reaction product is from 1:19 to 19:1.

10. The additive of claim 9 wherein said alkylphenol comprises a phenol of the formula

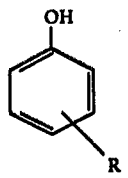

wherein R is an alkyl group having from 1 to 35 carbon atoms; said aldehyde comprises an aldehyde of the formula $$R^2-\overset{\overset{\displaystyle O}{\|}}{C}-H$$

wherein $R^2$ is selected from hydrogen and alkyl radicals containing 1 to 6 carbon atoms; said amine contains one amino group and at least one active hydrogen atom; and wherein the total number of carbon atoms in said reaction product is less than 36.

11. The additive of claim 10 wherein said polyalkylene amine has a molecular weight in the range 220 to 2700.

12. The additive of claim 11 wherein the ratio of said polyalkylene amine to reaction product is 1:1 to 4:1.

13. The additive of claim 12 wherein said polyalkylene amine is a polybutene amine.

14. The additive of claim 13 wherein said alkylphenol comprises dodecylphenol, said aldehyde is formaldehyde and said amine is methylamine and said polyalkyleneamine is a polyisobutylene amine having a molecular weight in the range 1000 to 1500.

15. The additive concentrate of claim 8 wherein said alkylene amine and said reaction product are dissolved in a solvent to form a concentrate containing 25 to 100 weight percent active ingredients.

* * * * *